US007757314B2

(12) United States Patent
Yul et al.

(10) Patent No.: US 7,757,314 B2
(45) Date of Patent: Jul. 20, 2010

(54) COLLAPSIBLE STRUCTURE

(75) Inventors: Lee Pil Yul, Fujian (CN); Huang Chang Jiu, Fujian (CN); Ye Zhengyi, Fujian (CN)

(73) Assignee: North Pole Limited, Kowloon (HK)

( * ) Notice: Subject to any disclaimer, the term of this patent is extended or adjusted under 35 U.S.C. 154(b) by 0 days.

(21) Appl. No.: 12/032,539

(22) Filed: Feb. 15, 2008

(65) Prior Publication Data

US 2008/0196162 A1 Aug. 21, 2008

(30) Foreign Application Priority Data

Feb. 15, 2007 (CN) ..... 2007 2 0006414 U

(51) Int. Cl.
*A47C 19/14* (2006.01)

(52) U.S. Cl. ..... 5/174; 5/110; 5/114

(58) Field of Classification Search ..... 5/110–115, 5/129, 174; 297/16.1–16.2
See application file for complete search history.

(56) References Cited

U.S. PATENT DOCUMENTS

| | | | | |
|---|---|---|---|---|
| 0,007,712 | A | | 10/1850 | Whitmarsh |
| 0,202,685 | A | | 4/1878 | White |
| 0,228,920 | A | | 6/1880 | Murray et al. |
| 0,540,041 | A | | 5/1895 | Blomberg |
| 0,862,346 | A | | 8/1907 | Pihlblad et al. |
| 0,904,006 | A | | 11/1908 | Oberg |
| 0,998,761 | A | | 7/1911 | Engstrand |
| 1,097,100 | A | | 5/1914 | Kallio |
| 1,151,495 | A | | 8/1915 | Menten |
| 1,176,963 | A | | 3/1916 | Howell |
| 1,185,568 | A | | 5/1916 | Zeunert |
| 1,224,782 | A | | 5/1917 | Pedersen |
| 1,312,299 | A | | 8/1919 | Almen |
| 1,367,955 | A | | 2/1921 | Finstrom |
| 1,439,272 | A | * | 12/1922 | Smith ..... 5/115 |
| 1,758,721 | A | | 5/1930 | Swartz et al. |
| 1,788,919 | A | | 1/1931 | Lansberry et al. |
| 2,416,496 | A | | 2/1947 | Piciulo |
| 2,579,263 | A | | 12/1951 | Kroha |
| 2,610,824 | A | | 9/1952 | Grier |
| 2,725,578 | A | | 12/1955 | Keller |
| 3,174,722 | A | | 3/1965 | Alm |
| 3,269,770 | A | | 8/1966 | Pellicane |
| 3,665,528 | A | | 5/1972 | Kjellberg et al. |
| 3,967,330 | A | | 7/1976 | Zawadowsky |
| 3,999,231 | A | | 12/1976 | Robins |
| 4,159,822 | A | | 7/1979 | Ota et al. |
| 4,304,017 | A | | 12/1981 | Mortimer |
| 4,384,379 | A | | 5/1983 | Yamada |
| 4,395,786 | A | | 8/1983 | Casey et al. |
| 4,463,463 | A | | 8/1984 | Kaneko |
| 4,598,434 | A | | 7/1986 | Mis |
| 4,670,922 | A | | 6/1987 | Mis |

(Continued)

*Primary Examiner*—Fredrick Conley
(74) *Attorney, Agent, or Firm*—Armstrong Teasdale LLP

(57) ABSTRACT

A collapsible structure is movable between an expanded configuration and a collapsed configuration. The collapsible structure includes a plurality of collapsible scissor assemblies. Each scissor assembly includes a first frame member pivotally coupled to a second frame member at a first pivot point. Frame members of adjacent scissor assemblies are coupled to a first connector assembly or a second connector assembly. A support assembly is coupled to a first scissor assembly and includes a member pivotally coupled at a first end to the first connector assembly or the first frame member and slidably coupled at an opposing second end to the second frame member.

23 Claims, 5 Drawing Sheets

U.S. PATENT DOCUMENTS 4,688,760 A 8/1987 Garman et al.
4,786,032 A 11/1988 Garman et al.
4,846,204 A 7/1989 Sok Kyu
5,197,781 A 3/1993 Tada
5,299,906 A 4/1994 Stone
5,419,534 A 5/1995 Vesely
5,542,806 A 8/1996 Kang
5,598,591 A 2/1997 Kelley
5,671,490 A 9/1997 Wu
D411,387 S 6/1999 Zheng
5,975,626 A 11/1999 Aycock
6,082,813 A 7/2000 Chen
6,101,647 A 8/2000 Stroud et al.
6,108,843 A 8/2000 Suzuki et al.
6,134,727 A 10/2000 Hwang
6,216,295 B1 4/2001 Pearson
6,231,119 B1 5/2001 Zheng
6,234,089 B1 5/2001 Zheng et al.
6,247,749 B1 6/2001 Yu
6,276,011 B1 8/2001 Antinori
6,286,812 B1 9/2001 Cherry
6,364,410 B1 4/2002 Tang
6,382,729 B1 5/2002 Wu
6,405,393 B2 6/2002 Megown
6,428,033 B1 8/2002 Harrison et al.
6,446,282 B1 * 9/2002 Wu ..... 5/115
6,457,192 B2 10/2002 Choi et al.
6,505,565 B1 1/2003 Byung et al.
6,564,402 B1 5/2003 Lin
6,581,223 B1 6/2003 Wang
6,654,973 B2 12/2003 Van Den Heuvel et al.
6,711,761 B2 3/2004 Choi
6,763,534 B2 7/2004 Hwang
6,820,927 B2 11/2004 Isom et al.
6,834,404 B2 12/2004 Fletcher
6,925,664 B1 8/2005 Twigg
6,926,355 B2 8/2005 Le Gette et al.
6,966,084 B2 11/2005 Le Gette et al.
7,040,347 B2 5/2006 Wang
7,103,927 B2 9/2006 Holub
7,114,205 B2 10/2006 Choi
7,198,324 B2 4/2007 Le Gette et al.
7,272,865 B2 9/2007 Le Gette et al.
D565,861 S 4/2008 Erickson

* cited by examiner

COLLAPSIBLE STRUCTURE

CROSS REFERENCE TO RELATED APPLICATIONS

This application claims the benefit of Chinese Patent Application 200720006414.0 entitled "Collapsible Structure" filed on Feb. 15, 2007, which is hereby incorporated by reference in its entirety.

BACKGROUND OF THE INVENTION

The field of the invention relates generally to foldable and/or collapsible furniture and, more particularly, to a collapsible support frame or base configured to support a mattress.

Conventional collapsible beds may include an air mattress that is supported by a collapsible frame. At least one such frame includes a plurality of uprights, which are joined by pivot assemblies such that the support frame as a whole expands outwardly from a central area when a portion of the frame is pulled outwardly. With the frame expanded, the uprights support an air mattress positioned on the uprights. Additionally, the conventional frame may include telescopic pole assemblies to reinforce the collapsible structure in the expanded configuration. However, such telescopic pole assemblies may be expensive to manufacture.

BRIEF DESCRIPTION OF THE INVENTION

In one aspect, a collapsible structure is provided. The collapsible structure is movable between an expanded configuration and a collapsed configuration and includes a plurality of collapsible scissor assemblies. Each scissor assembly of the plurality of scissor assemblies includes a first frame member pivotally coupled to a second frame member at a first pivot point. Frame members of adjacent scissor assemblies are coupled to one of a first connector assembly and a second connector assembly. A support assembly is coupled to a first scissor assembly of the plurality of scissor assemblies. The support assembly includes a member pivotally coupled at a first end to one of the first connector assembly and the first frame member and slidably coupled at an opposing second end to the second frame member.

In another aspect, a collapsible structure is provided. The collapsible structure includes a plurality of scissor assemblies. Each scissor assembly of the plurality of scissor assemblies includes two pivotally coupled frame members. A support assembly is operatively coupled to a first scissor assembly of the plurality of scissor assemblies. The support assembly includes a sliding member pivotally coupled to one of a connector assembly and a first frame member of the first scissor assembly and slidably coupled about a second frame member of the first scissor assembly.

In another aspect, a support frame is provided. The support frame is movable between a collapsed configuration and an expanded configuration for supporting a mattress. The support frame includes a first frame member and a second frame member. The first frame member and the second frame member have a first end, a second end and define a pivot point therebetween. A pivot member pivotally couples the first frame member to the second frame member at the pivot point to form a scissor assembly. A first connector assembly is pivotally coupled to a first end of the first frame member. A second connector assembly is pivotally coupled to a first end of the second frame member. A support assembly is operatively coupled to the scissor assembly. The support assembly includes a sliding member pivotally coupled to one of the first connector assembly and the first frame member and slidably coupled about the second frame member.

DETAILED DESCRIPTION OF THE INVENTION

Figure 1:
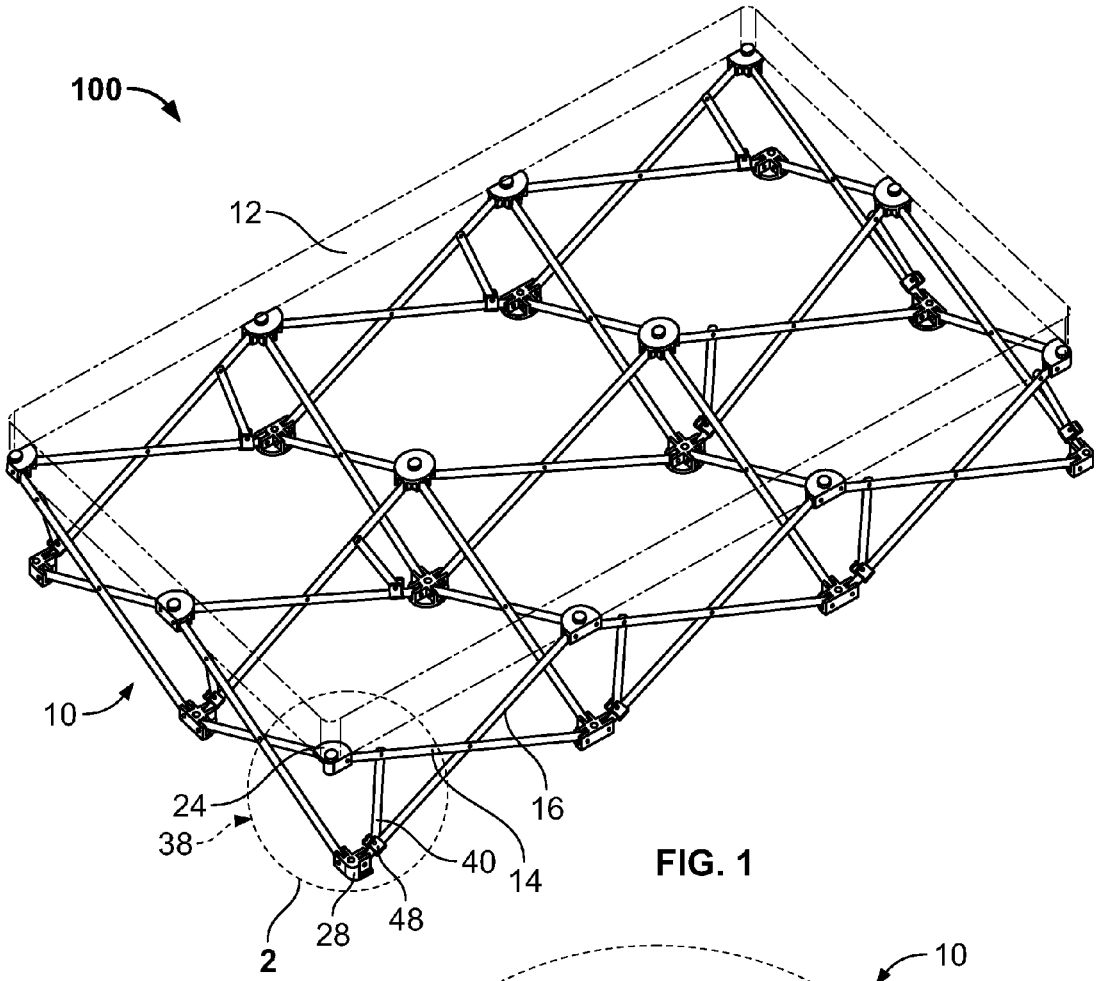
FIG. 1 is a perspective view of a bed including an exemplary collapsible frame in an expanded configuration.

The present disclosure provides a collapsible structure, such as a support frame that forms a support structure in an expanded configuration suitable for supporting a mattress, such as an inflatable mattress. The frame is configurable in a collapsed configuration for easy storage and/or transport. For example, in the collapsed configuration, the frame may be contained within a storage bag. When a sleeping area is desired, the frame is movable from the collapsed configuration to the expanded configuration to form a substantially planar support structure. The mattress is positioned on and supported by the frame in the expanded configuration. In one embodiment, the mattress is removably coupled to the frame.

In one embodiment, the frame includes a support assembly coupled to one or more scissor assemblies of the frame to retain the frame in an expanded configuration, as desired. In a particular embodiment, the support assembly includes a sliding member that is secured to a corresponding lower connector assembly or upper connector assembly to facilitate retaining the frame in the expanded configuration. The support assembly is integrated with or coupled to pivot joints of the frame such that the frame is moveable between the collapsed configuration and the expanded configuration as a unit with minimal effort by users. Further, the support assembly provides additional support for the frame in the expanded configuration and includes components that are easier and less expensive than conventional support assemblies to manufacturer and incorporate into the frame.

The present disclosure is described below in reference to its application in connection with and operation of a bed having a collapsible frame. However, it should be apparent to those skilled in the art and guided by the teachings herein provided that the collapsible frame is likewise applicable to any suitable foldable and/or collapsible furniture piece, for example. Referring to FIGS. 1-7, a bed 100 includes a collapsible frame 10 and a mattress 12, such as an inflatable mattress, shown in phantom lines in FIG. 1. In one embodiment, mattress 12 is removably positioned within a fabric covering that defines an enclosure having an entry that is sealed with a suitable closure mechanism or fastener, such as a zipper, buttons, snaps, hook-and-loop fastener components, such as VELCRO fastener components, and/or hook-and-eye fastener components. The fabric covering may be a plastic, cloth, or leather material, for example, and encloses at least a portion of mattress 12, which is inserted into the entry.

Referring further to FIGS. 1-7, articulated frame 10 includes a plurality of first frame members 14 pivotally coupled to a corresponding second frame member 16 at a pivot point or joint 18, such as at a midpoint 19 of first frame member 14 and second frame member 16, to form a scissor assembly 20. In one embodiment, a pivot member pivotally coupled first frame member 14 to second frame member 16. Each first frame member 14 is pivotally coupled at or near a first end portion 22 to an upper connector assembly 24 and pivotally coupled at or near an opposing second end portion 26 to a lower connector assembly or foot 28. Each second frame member 16 is pivotally coupled at or near a first end portion 32 to a corresponding lower connector assembly 28 and pivotally coupled at or near an opposing second end portion 34 to a corresponding upper connector assembly 24. Upper connector assembly 24 and/or lower connector assembly 28 couple adjacent or cooperating first frame members 14 and second frame members 16, so there are no loose pieces to be gathered and assembled.

Figure 4:
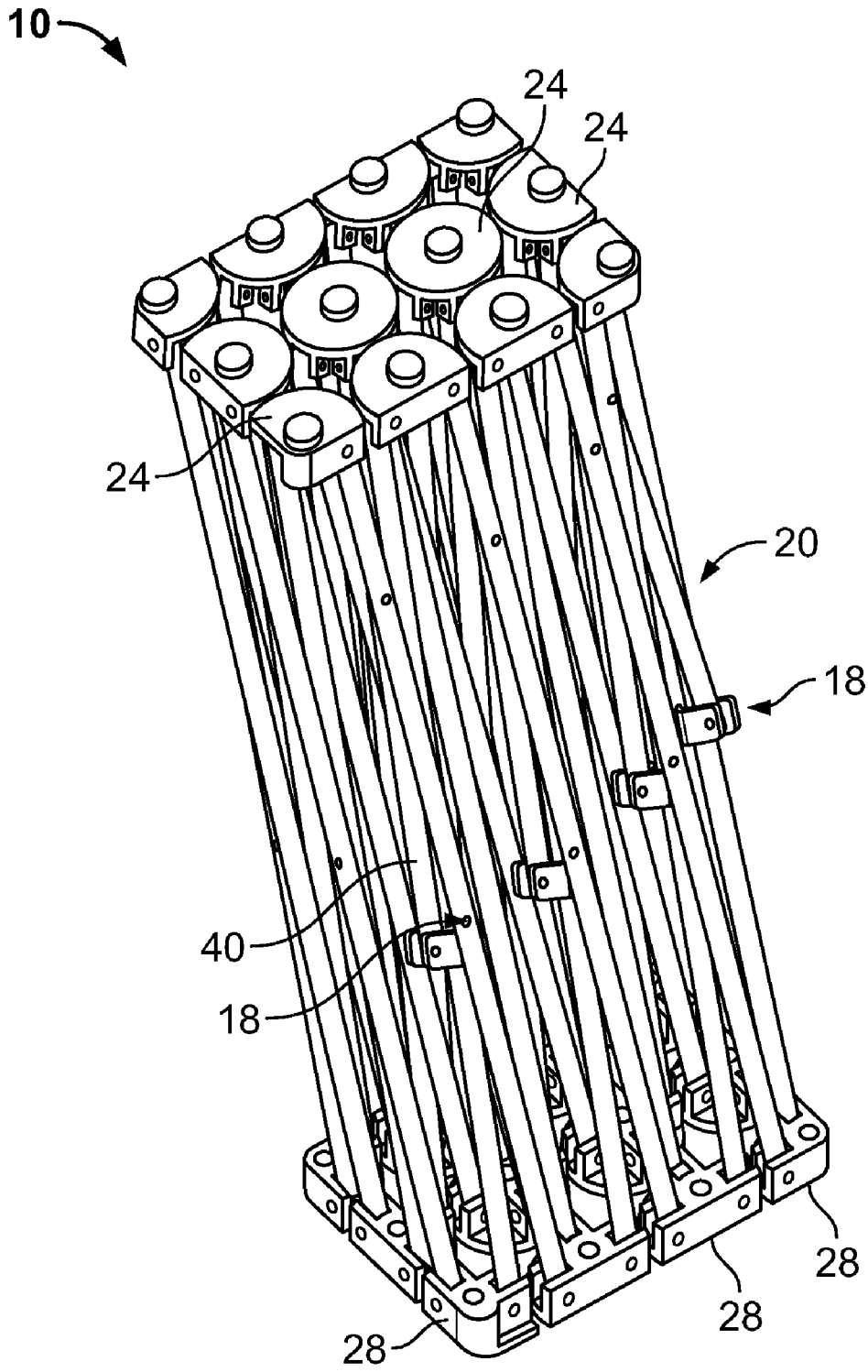
FIG. 4 is a perspective view of the collapsible frame shown in FIG. 1 in a collapsed configuration.
Figure 5:
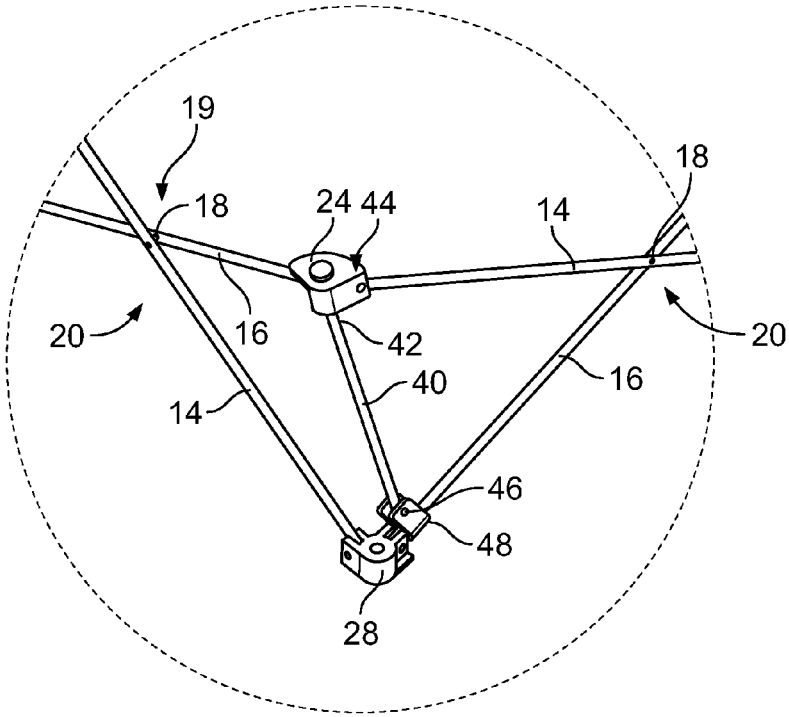
FIG. 5 is an enlarged view of a portion of an alternative exemplary collapsible frame.

Scissor assemblies 20 facilitate moving frame 10 between the expanded configuration, such as shown in FIG. 1, and the collapsed configuration, as shown in FIG. 4. More specifically, each scissor assembly 20 includes first frame member 14 pivotally coupled to corresponding second frame member 16 at pivot point 18. Frame 10 is moved towards the collapsed configuration as first frame member 14 pivots with respect to second frame member 16 to urge first end 22 of first frame member 14 towards second end 34 of second frame member 16 to urge adjacent upper connector assemblies 22 together. Similarly, second end 26 of first frame member 14 is urged towards first end 32 of second frame member 16 to urge adjacent lower connector assemblies 28 together. Conversely, frame 10 is moved towards the expanded configuration as first frame member 14 pivots with respect to second frame member 16 to urge first end 22 of first frame member 14 away from second end 34 of second frame member 16 to urge adjacent upper connector assemblies 22 apart. Similarly, second end 26 of first frame member 14 is urged away from first end 32 of second frame member 16 to urge adjacent lower connector assemblies 28 apart.

In one embodiment, a force directed at one or more corners of frame 10 causes movement in other comers such that frame 10 moves as a whole inwardly with respect to a central reference area of frame 10 to facilitate moving frame 10 to the collapsed configuration or outwardly relative to the central reference area to facilitate moving frame 10 to the expanded configuration. Further, upper connector assemblies 24 and lower connector assemblies 28, as well as pivot points 18, allow frame 10 to move as a unit when frame 10 is collapsed and expanded. It should be apparent to those skilled in the art and guided by the teachings herein provided that one lower connector assembly 28 may remain substantially fixed or stationary as frame 10 is collapsed or expanded, while the remaining lower connector assemblies 28 move inwardly or outwardly, respectively. As such, the central reference area may itself move. For example, when frame 10 is located within a room such that a lower connector assembly 28 is positioned in a corner of the room, movement of frame 10 is constrained. As frame 10 moves towards the expanded configuration, the remaining non-constrained lower connector assemblies 28 expand outwardly from the central reference area as the central reference area itself moves outwardly with respect to the stationary lower connector assembly 28.

Frame 10 includes a support assembly 38 operatively coupled to a corresponding scissor assembly 20. In one embodiment, support assembly 38 includes a sliding member 40 coupled to one or more scissor assemblies 20 to facilitate retaining frame 10 in the expanded configuration, as desired. As shown in FIGS. 1-4, in one embodiment, sliding member 40 is pivotally coupled to first frame member 14 between first end 22 and pivot point 18. In a particular embodiment, sliding member 40 is pivotally coupled at a first end 42 to first frame member 14 at a pivot point 44. In a further embodiment, pivot point 44 is positioned at a distance from first end 22 equal to about ⅙ of a length of first frame member 14. In alternative embodiments, pivot point 44 is positioned at any suitable distance from first end 22 such that sliding member 40 is operable as described herein.

Figure 2:
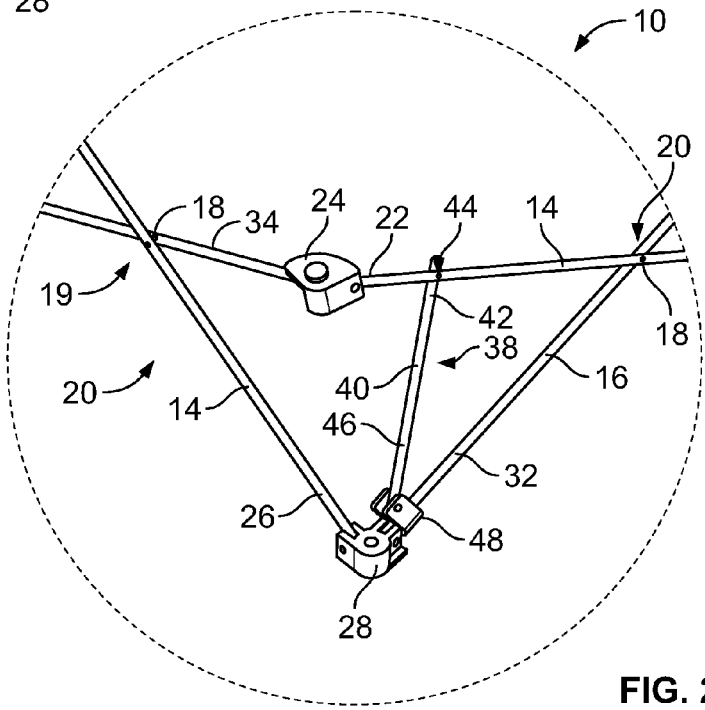
FIG. 2 is an enlarged view of a portion of the collapsible frame shown in FIG. 1.
Figure 3:
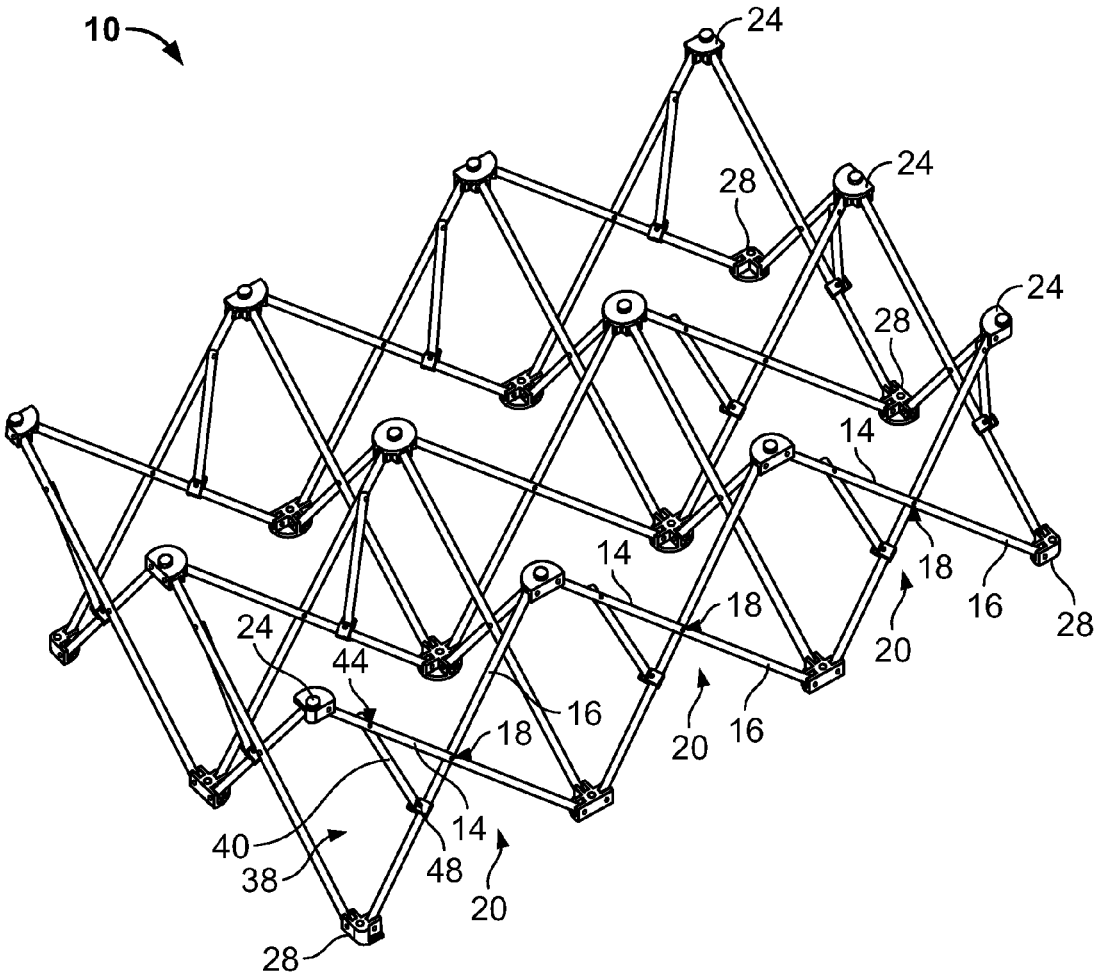
FIG. 3 is a perspective view of the collapsible frame shown in FIG. 1 in a partially collapsed configuration.

Referring further to FIG. 2, sliding member 40 is slidably coupled at an opposing second end 46 to corresponding second frame member 16 of scissor assembly 20 between corresponding lower connector assembly 28 and pivot point 18. In one embodiment, second end 46 is pivotally coupled to a collar 48 that is slidably positioned about second frame member 16. As frame 10 is moved towards the expanded configuration, first end 42 pivots about pivot point 44 and second end 46 of sliding member 40 moves along a length of second frame member 16 towards corresponding lower connector assembly 28. With frame 10 in the expanded configuration, second end 46 is secured to lower connector assembly 28 to facilitate retaining frame 10 in the expanded configuration, as desired. In a particular embodiment, collar 48 is releasably secured, such as locked, into lower connector assembly 28 to secure second end 46 to lower connector assembly 28. It should be apparent to those skilled in the art and guided by the teachings herein provided that any suitable securing and/or locking mechanism may be incorporated to releasably secure second end 46 and/or collar 48 to lower connector assembly 28. In one embodiment, collar 48 is releasably press-fitted into lower connector assembly 28. In a further embodiment, sliding member 40 or collar 48 forms a suitable projection that is fitted into or interferes with a cooperating void formed in lower connector assembly 28 to secure sliding member 40 to lower connector assembly 28.

In order to move frame 10 towards the collapsed configuration, second end 46 and/or collar 48 is unlocked from lower connector assembly 28. First end 42 pivots about pivot point 44 and second end 46 of sliding member 40 moves along the length of second frame member 16 towards corresponding pivot point 18 as frame 10 is moved towards the collapsed configuration. In alternative embodiments, sliding member 40 is pivotally coupled to second frame member 16 between first end 32 and pivot point 18 and slidably coupled to corresponding first frame member 14 of scissor assembly 20 between corresponding upper connector assembly 24 and pivot point 18.

In an alternative embodiment, sliding member 40 is pivotally coupled at first end 42 to upper connector assembly 24 and slidably coupled at opposing second end 46 to second frame member 16 of scissor assembly 20. In one embodiment, second end 46 is pivotally coupled to collar 48 that is slidably positioned about second frame member 16. As frame 10 is moved towards the expanded configuration, second end 46 of sliding member 40 moves along a length of second frame member 16 towards corresponding lower connector assembly 28. With frame 10 in the expanded configuration, second end 46 is secured to lower connector assembly 28 to facilitate retaining frame 10 in the expanded configuration, as desired. In a particular embodiment, collar 48 is locked into lower connector assembly 28 to secure second end 46 to lower connector assembly 28, such as described herein. In order to move frame 10 towards the collapsed configuration, second end 46 and/or collar 48 is unlocked from lower connector assembly 28. Second end 46 of sliding member 40 moves along the length of second frame member 16 towards corresponding pivot point 18 as frame 10 is moved towards the collapsed configuration. In further alternative embodiments, sliding member 40 is pivotally coupled to lower connector assembly 28 and slidably coupled to first frame member 14 of scissor assembly 20.

Figure 6:
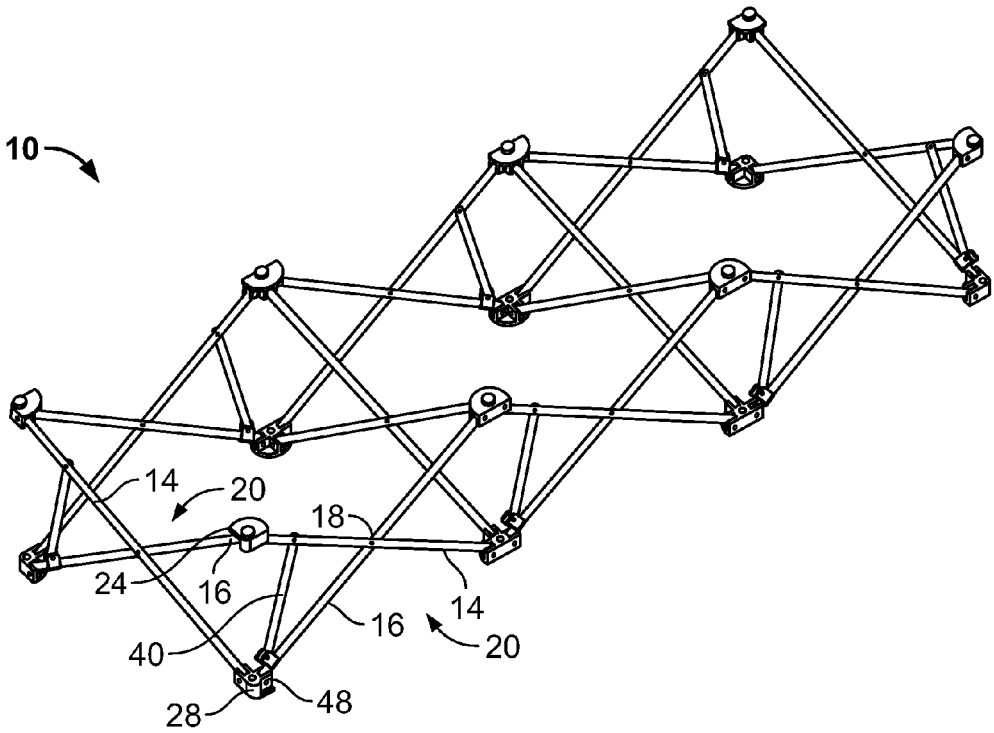
FIG. 6 is a perspective view of an alternative exemplary collapsible frame in an expanded configuration.
Figure 7:
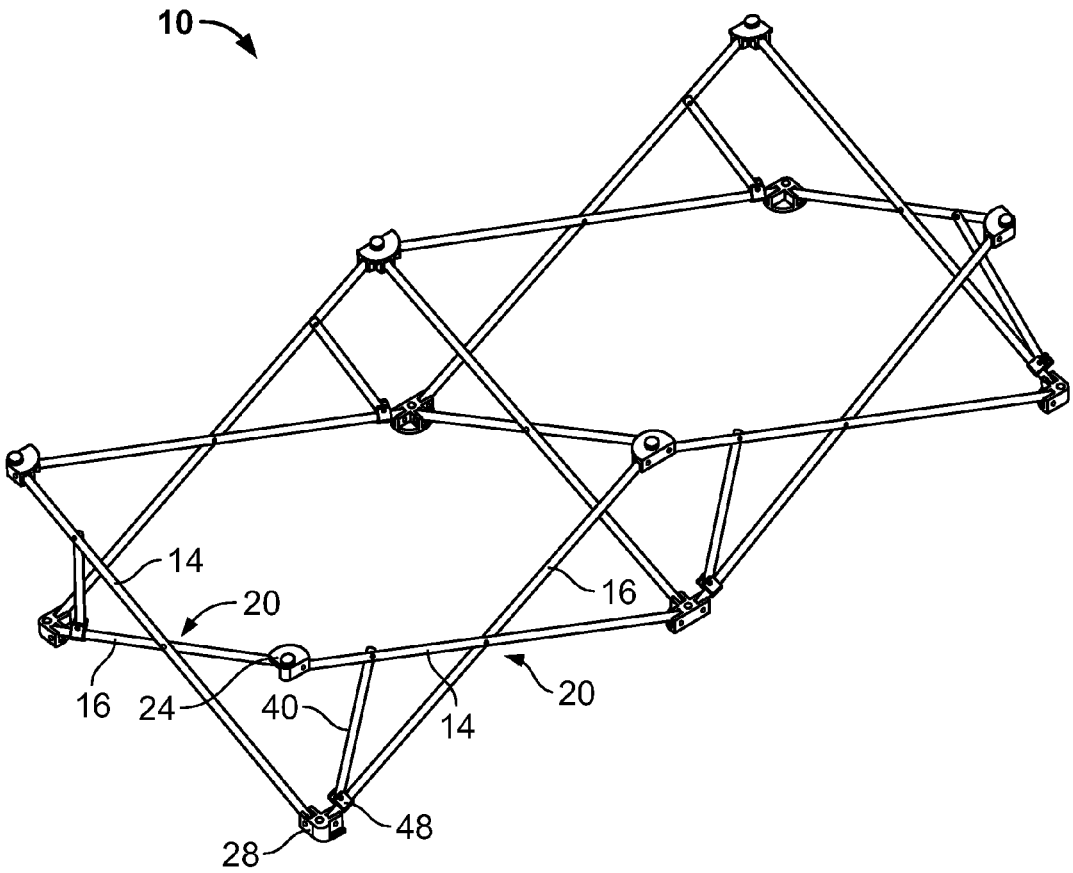
FIG. 7 is a perspective view of an alternative exemplary collapsible frame in an expanded configuration.

Although frame 10 may include any suitable number of scissor assemblies 20, in one embodiment, frame 10 is constructed of seventeen collapsible scissor assemblies 20, as shown in FIG. 1. Each scissor assembly 20 includes a first frame member 14 pivotally coupled to a second frame member 16 at a pivot point 18. Adjacent scissor assemblies 20 are coupled at upper ends by a corresponding upper connector assembly 24 and at lower ends by a corresponding lower connector assembly or foot 28. Thus, frame 10 is configured as an integrated unit having three longitudinal lines and four transverse lines. In an alternative embodiment, frame 10 is constructed of ten collapsible scissor assemblies 20, as shown in FIG. 6. Each scissor assembly 20 includes a first frame member 14 pivotally coupled to a second frame member 16 at a pivot point 18. Adjacent scissor assemblies 20 are coupled at upper ends by a corresponding upper connector assembly 24 and at lower ends by a corresponding lower connector assembly or foot 28. Thus, frame 10 is configured as an integrated unit having two longitudinal lines and four transverse lines. In a further alternative embodiment, as shown in FIG. 7, frame 10 is constructed of seven collapsible scissor assemblies 20. Each scissor assembly 20 includes a first frame member 14 pivotally coupled to a second frame member 16 at a pivot point 18. Adjacent scissor assemblies 20 are coupled at upper ends by a corresponding upper connector assembly 24 and at lower ends by a corresponding lower connector assembly or foot 28. Thus, frame 10 is configured as an integrated unit having two longitudinal lines and three transverse lines.

In one embodiment, bed 100 includes an inflatable mattress 12 coupled to a self-expanding frame 10. Mattress 12 is permanently or removably coupled to frame 10 directly or indirectly, such with an enclosure. Mattress 12 and/or the enclosure are permanently or removably coupled to frame 10 using a suitable fastener component, such as buttons, snaps, and/or hook-and-loop fastener components, such as VELCRO fastener components. In a particular embodiment, mattress 12 is coupled, directly or indirectly, to frame 10 at a plurality of locations such that as mattress 12 is filled with air to expand, frame 10 is urged to move outwardly. In a particular embodiment, an air pump can be coupled to an inflation port on mattress 12. The air pump may be electrically operated and powered by a wall current or by batteries. Further, the air pump may include a suitable sensor configured to detect a signal transmitted by a remote control. The remote control activates and deactivates the electric pump by transmitting a corresponding signal that is detected by the sensor. Alternatively or in addition, the air pump may have a manual on-off switch. In an alternative embodiment, mattress 12 is manually inflated.

In one embodiment, a collapsible bed includes an air mattress and a support frame. The support frame includes a plurality of frame members joined by pivot assemblies such that lower connector assemblies move laterally within a common horizontal plane as the support frame as a whole expands outwardly from a central reference area to expand the collapsible bed outwardly from the central reference area. The support frame is urged outwardly from the central reference area, thus causing the support frame to expand outwardly as a whole from the central reference area and the mattress is inflated. In a particular embodiment, the mattress is coupled to the support frame at a plurality of attachment points such that as the mattress is inflated and expands outwardly, the support frame also expands outwardly. The mattress may be coupled to the support frame with a fabric covering, which encloses at least a portion of the mattress. The fabric covering is coupled to the support frame at a plurality of attachment points such that as the mattress is inflated and expands outwardly, the fabric covering expands outwardly, causing the support frame to also expand outwardly.

The present disclosure provides a collapsible structure that includes collapsible scissor assemblies. A support assembly is coupled to one or more of the scissor assemblies to provide the frame with additional support for supporting a mattress and a user. Each support assembly includes a sliding member pivotally coupled to a first frame member of the scissor assembly and slidably coupled to the second frame member of the scissor assembly. In one embodiment, the support assembly is integrated with or incorporated into the construction of the scissor assembly such that the frame collapses and expands as a unit with minimal effort by users. Further, the support assembly provides a steady support for the frame such that the support structure is adequately strong to support a user, while decreasing manufacturing costs for the frame.

The above-described bed and collapsible frame facilitate providing a sleeping area quickly and efficiently. More specifically, the collapsible frame is movable between a collapsed configuration, facilitating storage and/or transportation of the bed, and an expanded configuration defining a substantially planar support structure configured to support a mattress.

Exemplary embodiments of a collapsible frame and method of constructing or making a bed are described above in detail. The apparatus and method are not limited to the specific embodiments described herein, but rather, components of the apparatus and/or steps of the method may be utilized independently and separately from other components and/or steps described herein. Further, the described apparatus components and/or method steps can also be defined in, or used in combination with, other apparatus and/or methods, and are not limited to practice with only the apparatus and method as described herein.

While the invention has been described in terms of various specific embodiments, those skilled in the art will recognize that the invention can be practiced with modification within the spirit and scope of the claims.

What is claimed is:

1. A collapsible structure movable between an expanded configuration and a collapsed configuration, said collapsible structure comprising:

a plurality of collapsible scissor assemblies, each scissor assembly of said plurality of scissor assemblies comprising a first frame member pivotally coupled to a second frame member at a first pivot point to form a respective scissor assembly, frame members of adjacent scissor assemblies coupled to one of a first connector assembly and a second connector assembly, said first frame member pivotally coupled to said first connector assembly; and a support assembly coupled to a first scissor assembly of the plurality of scissor assemblies, said support assembly comprising a member pivotally coupled at a first end to one of said first connector assembly and said first frame member and slidably coupled at an opposing second end to said second frame member.

2. A collapsible structure in accordance with claim 1 wherein said member is pivotally coupled to said first frame member at a second pivot point positioned between a first end of said first frame member and said first pivot point.

3. A collapsible structure in accordance with claim 2 wherein said second pivot point is positioned at a distance from said first end equal to ⅙ of a length of said first frame member.

4. A collapsible structure in accordance with claim 2 wherein said member is slidably coupled to said second frame member between a first end of said second frame member and said first pivot point.

5. A collapsible structure in accordance with claim 4 wherein said member second end is slidably movable along a length of said second frame member between said second frame member first end and said first pivot point.

6. A collapsible structure in accordance with claim 1 wherein said member second end is releasably secured to said second connector assembly to facilitate retaining said structure in the expanded configuration.

7. A collapsible structure in accordance with claim 6 wherein said collar is releasably secured to said second connector assembly to facilitate retaining said structure in the expanded configuration.

8. A collapsible structure in accordance with claim 6 wherein said collar is slidably movable along a length of said second frame member between said second frame member first end and said first pivot point.

9. A collapsible structure in accordance with claim 1 wherein said support assembly further comprises a collar coupled to said second end of said member, said collar slidably coupled about said second frame member between said second frame member first end and said first pivot point.

10. A collapsible structure in accordance with claim 1 wherein said first connector assembly comprises one of an upper connector assembly and a lower connector assembly.

11. A bed comprising:

a collapsible structure in accordance with claim 1; and an inflatable mattress operatively coupled to said collapsible structure.

12. A collapsible structure comprising a plurality of scissor assemblies, each scissor assembly of said plurality of scissor assemblies comprising two pivotally coupled frame members coupled at a pivot point to form a respective scissor assembly, and a support assembly operatively coupled to a first scissor assembly of said plurality of scissor assemblies, said support assembly comprising a sliding member pivotally coupled to one of a connector assembly and a first frame member of said first scissor assembly and slidably coupled about a second frame member of said first scissor assembly, said first frame member pivotally coupled to said connector assembly.

13. A collapsible structure in accordance with claim 12 wherein said sliding member is slidably coupled between a lower end of said first frame member and a pivot joint of said first scissor assembly and is pivotally coupled to said second frame member between an upper end of said second frame member and said pivot joint.

14. A collapsible structure in accordance with claim 12 wherein said sliding member is slidably coupled between an upper end of said first frame member and a pivot joint of said first scissor assembly and is pivotally coupled to said second frame member between a lower end of said second frame member and said pivot joint.

15. A collapsible structure in accordance with claim 12 wherein said sliding member is slidably coupled between a lower end of said first frame member and a pivot joint of said first scissor assembly and is pivotally coupled to an upper connector assembly configured at an upper end of said second frame member.

16. A collapsible structure in accordance with claim 12 wherein said sliding member is slidably connect between an upper end of said first frame member and a pivot joint of said first scissor assembly and is pivotally coupled to a lower connector assembly configured at a lower end of said second frame member.

17. A collapsible bed comprising:

a collapsible structure in accordance with claim 12; and an inflatable mattress operatively coupled to said collapsible structure.

18. A support frame movable between a collapsed configuration and an expanded configuration for supporting a mattress, said support frame comprising:

a first frame member and a second frame member, said first frame member and said second frame member having a first end, a second end and defining a pivot point therebetween;

a pivot member pivotally coupling said first frame member to said second frame member at said pivot point to form a scissor assembly;

a first connector assembly pivotally coupled to a first end of said first frame member;

a second connector assembly pivotally coupled to a first end of said second frame member; and a support assembly operatively coupled to said scissor assembly, said support assembly comprising a sliding member pivotally coupled to one of said first connector assembly and said first frame member and slidably coupled about said second frame member.

19. A support frame in accordance with claim 18 wherein said sliding member is slidably coupled between a lower end of said second frame member and said pivot point and is pivotally coupled to said first frame member between an upper end of said first frame member and said pivot point.

20. A support frame in accordance with claim 18 wherein said sliding member is slidably coupled between an upper end of said second frame member and said pivot point and is pivotally coupled to said first frame member between a lower end of said first frame member and said pivot point.

21. A support frame in accordance with claim 18 wherein said sliding member is slidably coupled between a lower end of said second frame member and said pivot point and is pivotally coupled to said first connector assembly.

22. A support frame in accordance with claim 18 wherein said first connector assembly comprises one of an upper connector assembly and a lower connector assembly.

23. A collapsible bed comprising:

a support frame in accordance with claim 18; and an inflatable mattress operatively coupled to said support frame.

* * * * *